US005737786A

United States Patent [19]

Yamamoto

[11] Patent Number: 5,737,786

[45] Date of Patent: Apr. 14, 1998

[54] COLLAPSIBLE BED STRUCTURE FOR BED-RIDDEN INVALIDS

[76] Inventor: Tsuneo Yamamoto, 20-ban, Shirinashi, Tameto-cho, Toyokawa-shi, Aichi, Japan

[21] Appl. No.: 690,146

[22] Filed: Jul. 31, 1996

[30] Foreign Application Priority Data

Mar. 1, 1996 [JP] Japan ..... 8-044608

[51] Int. Cl.[6] ..... A61G 7/16

[52] U.S. Cl. ..... 5/618; 5/617; 5/616; 5/81.1; 5/83.1

[58] Field of Search ..... 5/617, 118, 619, 5/616, 113, 81.1, 83.1, 691, 614; 4/300, 547, 561.1

[56] References Cited

U.S. PATENT DOCUMENTS

| | | | |
|---|---|---|---|
| 2,500,544 | 3/1950 | Haskins | 5/618 |
| 2,588,854 | 5/1952 | Lang | 5/618 |
| 3,371,357 | 3/1968 | Berthelsen et al. | 5/83.1 |
| 4,085,471 | 4/1978 | DiMatteo et al. | 5/83.1 |
| 4,093,305 | 6/1978 | Staroste et al. | 5/113 |
| 4,856,123 | 8/1989 | Henderson et al. | 5/618 |
| 5,101,519 | 4/1992 | Yamamoto | 4/300 |
| 5,193,633 | 3/1993 | Ezenwa | 5/618 |
| 5,400,448 | 3/1995 | Zwickey | 5/691 |

*Primary Examiner*—Steven N. Meyers
*Assistant Examiner*—Fredrick Conley
*Attorney, Agent, or Firm*—Sughrue, Mion, Zinn, Macpeak & Seas, PLLC

[57] ABSTRACT

In a collapsible bed structure for bed-ridden invalids, a bed section is provided on an upper open end of a bathtub, the bed section having at least first, second and third bed plates each pivotably connected at their neighboring side. A link structure is provided to change the bed section between a rest position in which the first, second and third bed plates are horizontally supported and an operative position in which the first, second and third bed plates are supported in a chair-shaped configuration within the bathtub. A pedestal plate is pivotably placed at one end by a hinge to the first plate of the bed section, the pedestal plate having a rack operative to move the pedestal plate upward around the hinge so as to raise the haunches of an occupant lying on the bed section to expedite the occupant's divestiture. A slide plate is slidably mounted on each of the first and second bed plates of the bed section to slightly slide along a lengthwise direction of the occupant so as to prevent a slippage between the occupant lying on the bed section and the first and second bed plates when changing the bed section from the rest position to the operative position.

8 Claims, 20 Drawing Sheets

COLLAPSIBLE BED STRUCTURE FOR BED-RIDDEN INVALIDS

BACKGROUND OF THE INVENTION

1. Field of the Invention

This invention relates to a collapsible bed structure for bed-ridden invalids which reduces the difficulties encountered upon their relieving themselves and taking a bath.

2. Description of Prior Art

For bed-ridden invalids, bedsores (decubiti) tend to develop irrespective of careful nursing and the great care given the invalids unless they are turned periodically in bed. Upon relieving themselves and taking a bath, a considerable amount of care is likely to be required which inevitably increases concomitant cost with a lengthened attendance. This causes their family to lead an unpleasant daily life and increases the psychological burden of the invalids who struggle with their illness.

In the state-of-art invalid bed device, a bedpan is used for the invalids for relieving themselves, or otherwise the invalids are transferred to a stool by the physical lifting of the attendant who has to change a diaper of the invalids each time they relieve themselves.

Upon taking a bath, the invalids are bear-hugged and lifted in order to be carried to a bathtub by their attendant, or otherwise they are transferred by stretchers, lifts or the like.

In any case, the invalids feel uneasiness or anxiety during their transit. On the other hand, attention should be drawn to the physical burden the attendant undertakes. This makes the invalids end up infrequently taking a bath, thus suffering from an offensive odor they have to emanate, however seriously they wish to always keep themselves sanitary.

It is for this reason why an invalid bed structure has been desired which is capable of aiding invalids relieve themselves and allow them to take a bath with the least burden the attendant can bear. This demand will be more pressing when considering an ageing society, both home and abroad, to come in the not-too-distant future.

Therefore, it is a first object of the invention to provide a collapsible bed structure for bed-ridden invalids which is capable of helping them relieve themselves and take a bath with the least attendance so as to lessen the burden the attendant undertakes.

It is a second object of the invention to provide a collapsible bed structure for bed-ridden invalids which is suited for the invalids who wish to take care of themselves voluntarily without exposing themselves to the outside even if it takes a longer time, and keeping themselves sanitary to protect themselves against sequela which may ensue.

SUMMARY OF THE INVENTION

According to the present invention, there is provided a collapsible bed structure for bed-ridden invalids: a bed section provided on an upper open end of a bathtub, the bed section having at least first, second and third bed plates each pivotably connected at their neighboring side; a link structure provided to change the bed section between a rest position in which the first, second and third bed plates are horizontally supported and an operative position in which the first, second and third bed plates are supported in a chair-shaped configuration within the bathtub; a pedestal plate pivotably placed at one end by a hinge to the first plate of the bed section, the pedestal plate having a drive rod to move the pedestal plate upward around the hinge so as to raise the haunches of an occupant lying on the bed section to expedite the occupant's divestiture; and a plurality of slide plates each slidably mounted on the first and second bed plates of the bed section to slightly slide along a lengthwise direction of the occupant so as to prevent a slippage between the occupant lying on the bed section and the first and second bed plates when changing the bed section from the rest position to the operative position.

With the operation of the drive rod, the pedestal plate is pushed upward to raise the occupant's haunches from the first bed plate to make room between the occupant's haunches and the first bed plate. The room thus appeared makes it possible to readily change clothes or undress the occupant when taking a bath and relieving him/herself. This is particularly convenient when the occupant is heavy.

With the slide plate moving slightly along the lengthwise direction of the occupant, it is possible to prevent a forcible slippage of the occupant's back and haunches against the first and second bed plates when changing the bed section from the rest position to the operative position. This makes it possible to smoothly change the positions with ease.

According to another aspect of the present invention, a foot plate is pivotably connected to have a slide plate slidably mounted on the foot plate so as to slightly slide the foot plate outwardly when changing the bed section from the rest position to the operative position.

With the change of the bed section from the rest position to the operative position, the foot plate moves the occupant's feet outward while supporting the occupant's feet, thus automatically setting the occupant's feet in a comfortable position so as to change positions with ease.

According to another aspect of the present invention, a canopy is provided which has a plurality of inverted L-shape ribs and a hood provided to wrap the ribs, each lower end of the ribs being collected to be pivotably supported by the upper open end of the bathtub so as to change the canopy between a first position in which the ribs are rested on the upper open end of the bathtub and a second position in which the ribs are open fanwise so as to conceal the occupant lying on the bed section.

With the ribs pivotably mounted on the upper open end of the bathtub, it is possible to open the canopy in a fanwise so as to conceal the occupant by the canopy especially upon taking a bath. This makes it positive to taking a bath because no attention need be paid to the outside. With the canopy mounted on the bathtub, it is possible to retain aqua vapor in the bathtub, thus preventing the aqua vapor from leaking into a compartment in which the bathtub is installed.

According to another aspect of the present invention, an elastic strip sheet is provided at a boundary straddling at least the first and second bed plates so as to prevent the mattress on a bed section from being caught up therebetween.

With the elastic strip sheet provided between the first plate and the second plate, it is possible to effectively prevent the mattress from being caught up therebetween when changing the bed section from the rest position to the operative position.

According to another aspect of the present invention, an opening is provided on the second bed plate in correspondence to a toilet placed on a bottom of the bathtub, so that the opening meets an upper portion of the toilet with no warm water supplied to the bathtub when changing the bed section from the rest position to the operative position.

Upon raising the occupant's haunches upward with the bed section at the rest position, a lid is taken to reveal the opening of the first bed plate while divesting the underwear of the occupant. The occupant can relieve him/herself comfortably because the opening automatically meets the upper portion of the toilet in combination with the change of the bed section from the rest position to the operative position. This makes it possible for the occupant to relieve him/herself with the least trouble, thus considerably lessening the burden which the attendant usually bears so as to sufficiently cope with the ageing society to come.

BRIEF DESCRIPTION OF THE DRAWINGS

These and other objects, aspects and embodiments of the invention will be described in more detail with reference to the following drawing figures, of which.

DETAILED DESCRIPTION OF PREFERRED EMBODIMENTS OF THE INVENTION

Figure 1:
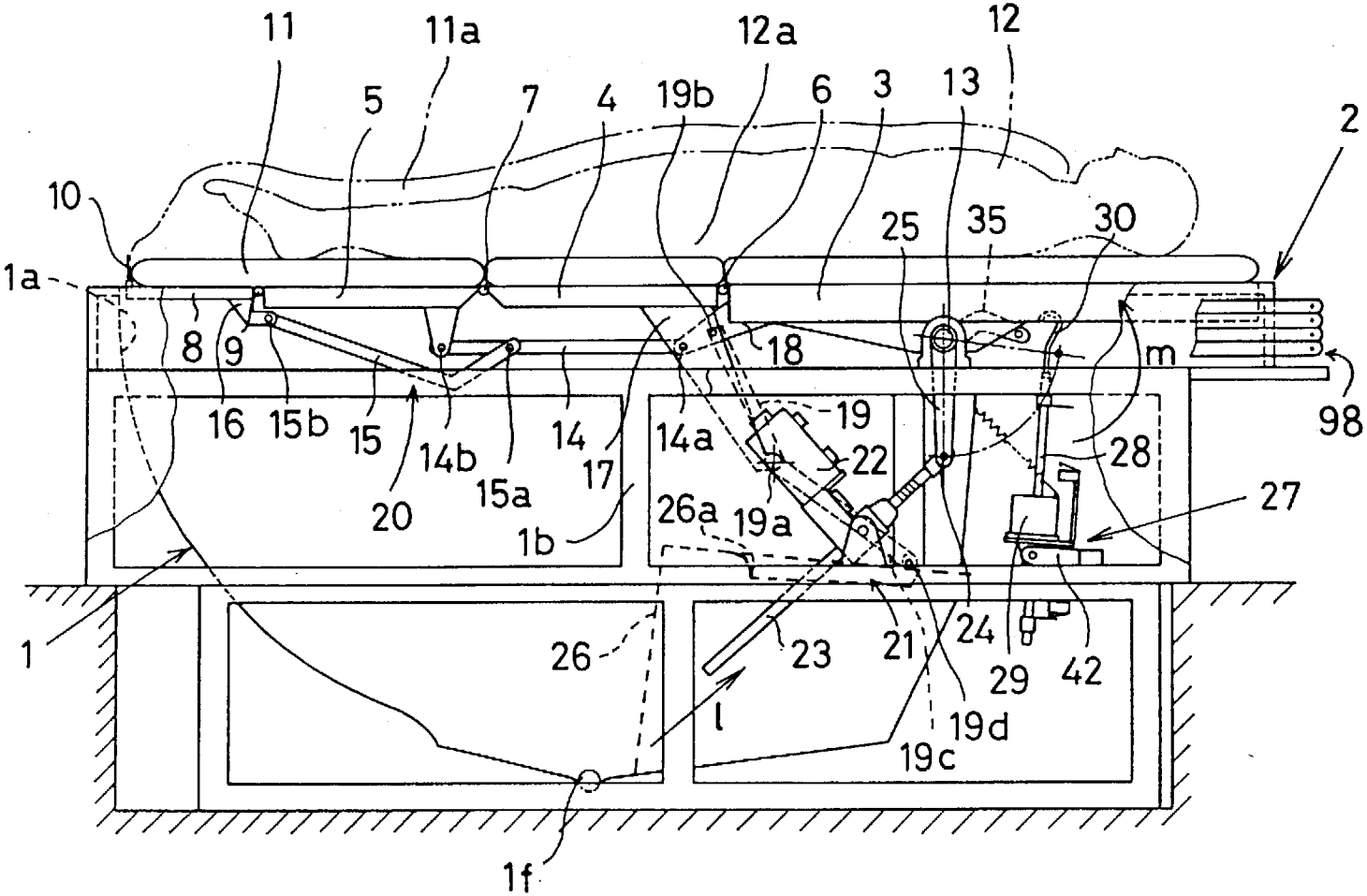
FIG. 1 is an elevational view of a collapsible bed structure for bed-ridden invalids according to an embodiment of the invention.
Figure 2:
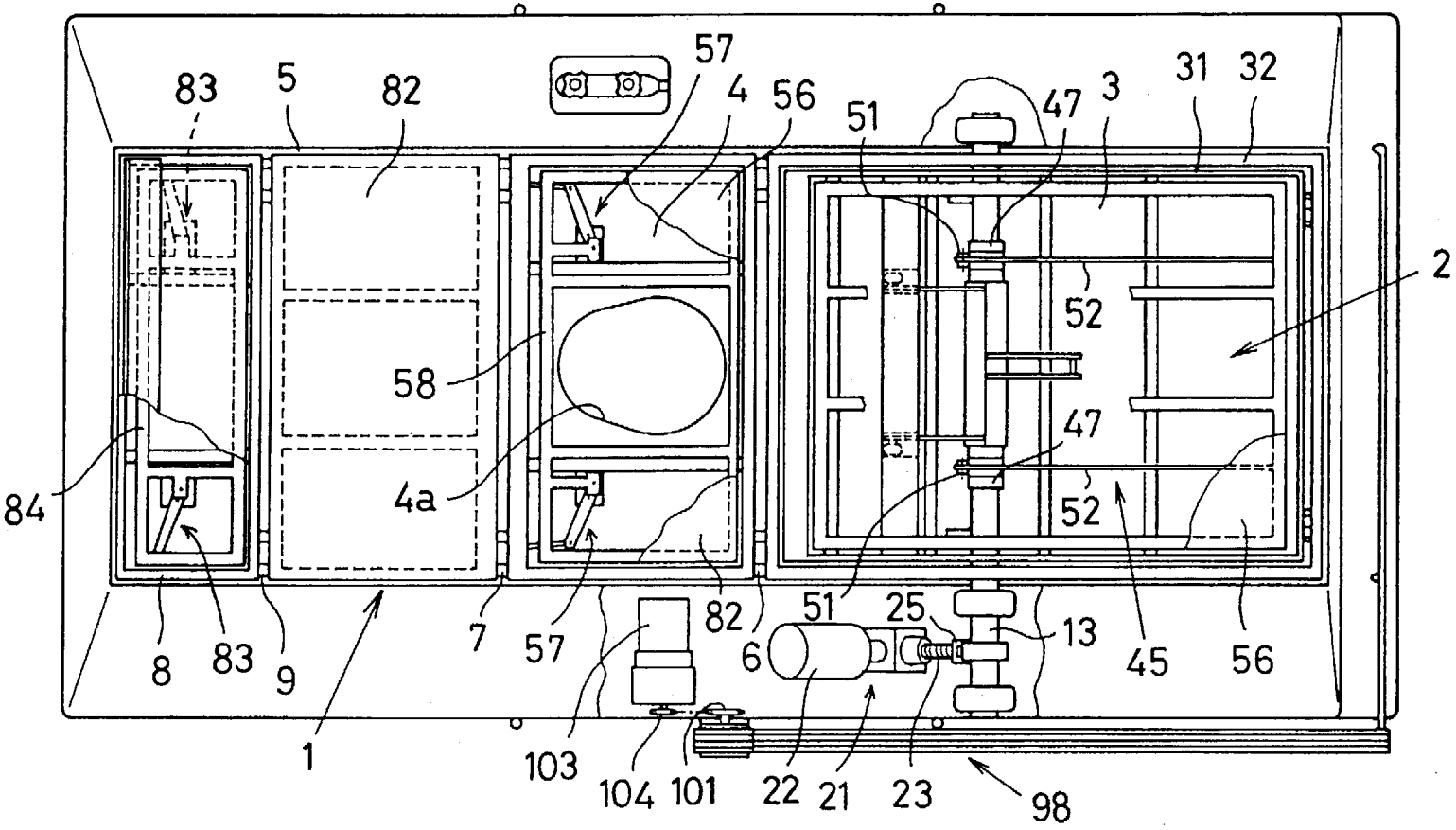
FIG. 2 is a plan view of a bed section of the collapsible bed structure for bed-ridden invalids.
Figure 3:
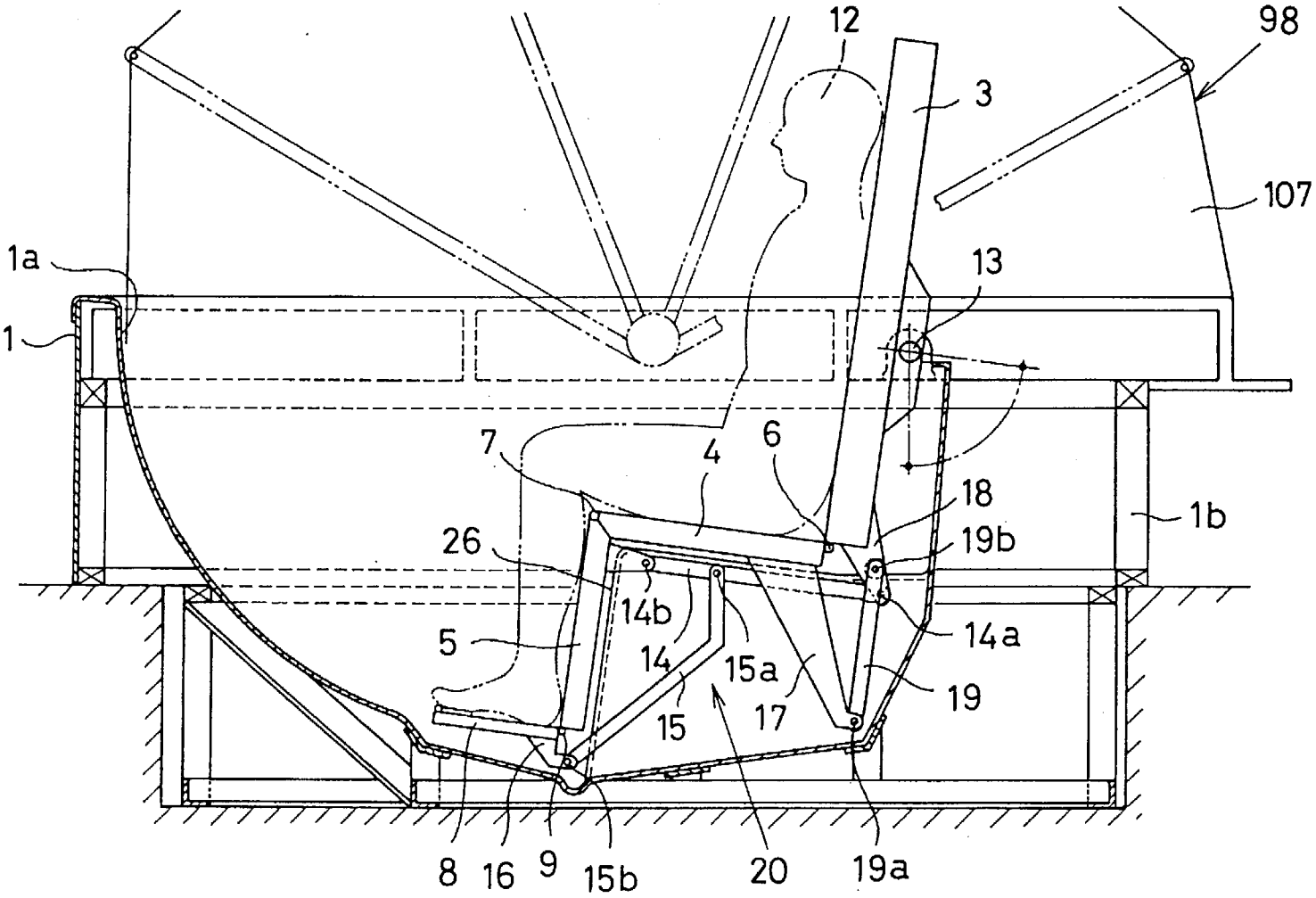
FIG. 3 is a cross sectional view of the bed section changed from a rest position to an operative position.

Referring to FIGS. 1 through 3 which show a schematic view of a collapsible bed structure for bed-ridden invalids according to an embodiment of the invention, a bathtub 1 is placed in a compartment of a house. By way of illustration, the bathtub 1 is surrounded by a rectangular frame structure 1*b*. On an upper open end 1*a* of the bathtub 1, a flat bed section 2 is horizontally installed to cover the open area of the bathtub 1. The bed section 2 has first, second and third bed plates 3, 4, 5. The first bed plate 3 is pivotably connected at one side to one side of the second bed plate 4 by means of a hinge 6, while the third bed plate 5 is pivotably connected at one side to the other side of the second bed plate 4 by means of a hinge 7. To the other side of the third bed plate 5, a foot rest plate 8 is pivotably connected by means of a hinge 9. On the other side of the foot rest plate 8 opposite to the hinge 9, a stop bar 10 is pivotably mounted by means of a pin to receive a rear end of a mattress 11 through which an occupant 12 lies on the bed section 2.

Across the upper open end 1*a* of the bathtub 1, a rotational shaft 13 is rotatably supported to which the first bed plate 3 is fixed. The first bed plate 3 and the third bed plate 5 are supported at pins 14*a*, 14*b* by a link 14. Between the link 14 and a link 16 secured to the foot rest plate 8, a link 15 is pivotably connected by means of pins 15*a*, 15*b*. Between an arm 17 fixed at an underside of the second bed plate 4 and an arm 18 fixed at an underside of the first bed plate 3, a link 19 is connected by means of pins 19*a*, 19*b*.

With an assist of a linkage structure 20 having the links 14, 15, 16, 19 and pins 14*a*, 14*b*, 15*a*, 15*b*, 19*a*, 19*b*, the cantilever bed section 2 is supported horizontally by the rotational shaft 13. Numeral 19*c* designates a link arm which connects at one end to the pin 19*a* of the link 19, and the same time, connecting at the other end to an inner side of the bathtub 1 by means of a pin 19*d* so as to supplementarily support the second bed plate 4 when changing the bed section 2 from a rest position to an operative position as described hereinafter.

Numeral 21 designates a drive mechanism fixedly installed on the frame structure 1*b* in the proximity of an elevational side of the bathtub 1. The drive mechanism 21 has an electric motor 22 which reciprocally moves a screw rod 23 in its axial direction. The screw rod 23 has one end connected to the rotational shaft 13 by way of a pin 24 and a link 25. Upon energizing the motor 22, the screw rod 23 moves in the direction of arrow (l) to pivot the first bed plate 3 around the rotational shaft 13 in the direction of arrow (m) by way of the link 25. With the pivotal movement of the first bed plate 3, the second bed plate 4, the third plate 5 and the foot rest plate 8 pivotally move around the hinges 6, 7, 9 respectively in cooperation with the linkage structure 20.

This movement changes the bed section 2 from the rest position in which the first, second and third bed plates 3, 4, 5 are aligned horizontally to the operative position in which the first, second and third bed plates 3, 4, 5 are each turned at the hinges 6, 7, 9 to form into a chair-shaped configuration as shown in FIG. 3. These particulars are disclosed in U.S. Pat. No. 5,101,519 granted to the same Applicant on Apr. 7, 1992.

In this situation, a certain amount of warm water is supplied to the bathtub 1 with the mattress 11 and a coverlet 11*a* previously removed when taking a bath. Upon relieving him/herself, it is possible for the occupant to use the toilet 26 with the bathtub 1 kept empty. To meet this requirement, an opening 4*a* is provided on the second bed plate 4 in a position to correspond to haunches 12*a* of the occupant lying on the bed section 2. To an underside of the mattress 11, a lid plate F is attached to close the opening 4*a*. In combination with removing the mattress 11 from the bed section 2 upon relieving themselves and taking a bath, the lid plate F is taken out to reveal the opening 4a. Upon changing the bed section 2 from the rest position to the operative position, the opening 4a is adapted to meet an upper end 26a of the toilet 26 which is mechanically opened before the bed section 2 is changed to the operative position. Notation 1f designates a drain hole to exhaust the warm water after taking a bath.

Figure 4:
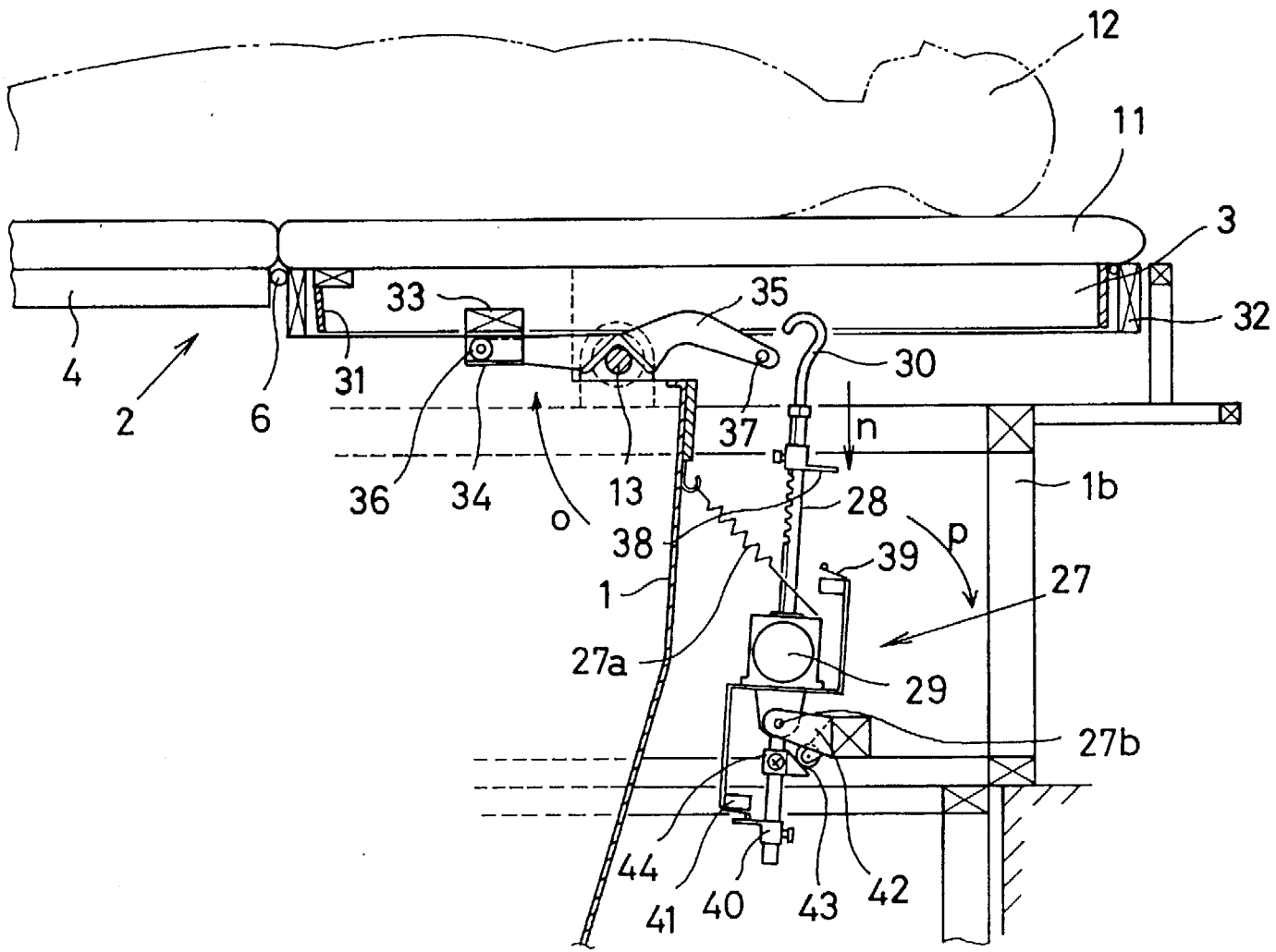
FIG. 4 is a partial cross sectional view mainly showing a pedestal plate before being pushed upward to raise the occupant's haunches.

FIG. 4 shows a rise-up mechanism 27 provided to raise the occupant's haunches 12a from the first bed plate 3 of the bed section 2. In the rise-up mechanism 27, a pivot shaft 27b is provided on the frame structure 1b to rockably swing the rise-up mechanism 27 which is always urged toward the bathtub 1 by means of a coil spring 27a. The rise-up mechanism 27 has an electric motor 29 to reciprocally move a rack 28 in its axial direction (substantially up-and-down direction). An upper end of the rack 28 has a hook portion 30. Numeral 31 designates an inner frame (pedestal plate) located within an outer frame 32 of the first bed plate 3. Across an underside of the inner frame 31, a beam 33 is provided to secure an angular rail 34 along the lengthwise direction of the occupant 12. A rocker arm 35 is rotatably mounted on the rotational shaft 13. The rocker arm 35 has one end pivotably connected to a roller 36 movably mounted on the rail 34, and having the other end detachably connected to the hook portion 30 by way of a pin 37.

Upon changing underwear or divesting the occupant 12, with the bed section 2 in the rest position, a motor 29 is energized by means of, for example, a teleoperational panel (not shown). Then the rack 28 axially moves downward in the direction of arrow (n) so as to engage the hook portion 30 with the pin 37, thus pivoting the rocker arm 35 around the rotational shaft 13 in the direction of arrow (o). With the pivotal movement of the rocker arm 35, the roller 36 moves along the rail 34 to pivot the inner frame 31 upward about the shaft 13 in the direction of arrow (o), thus raising the occupant's haunches 12a to a divesting position. Upon reaching the divesting position, an underpiece 40 moves away from a lower limit switch 41, while an upperpiece 38 engages against an upper limit switch 39 to deenergize the motor 29 so as to stop the downward movement of the rack 28.

With the help of the rise-up mechanism 27, it is possible to quickly divest the occupant's underwear with the least trouble, thus significantly lessening the burden the attendant would have to bear. This is particularly convenient when the occupant 12 is heavy in weight.

Figure 6:
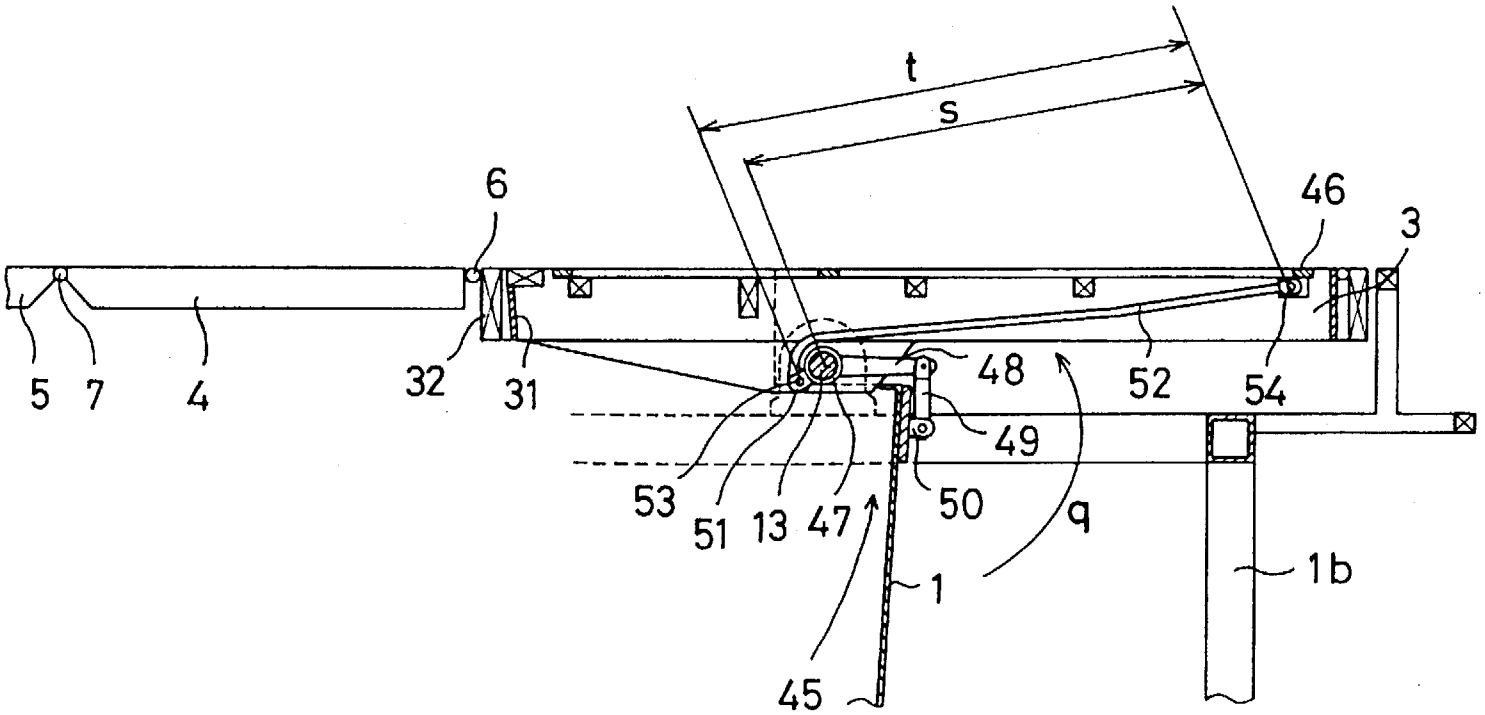
FIG. 6 is a partial cross sectional view of a slip cancelling mechanism mounted on a first bed plate of the bed section.

After divesting the occupant's underwear, an operation of the panel energizes the motor 29 again to axially move the rack 28 upward in the opposite direction of arrow (n) so as to disengage the hook portion 30 from the pin 37, thus pivoting the rocker arm 35 around the rotational shaft 13 in the opposite direction of arrow (o). With the pivotal movement of the rocker arm 35, the roller 36 moves along the rail 34 to pivot the inner frame 31 downward about the rotational shaft 13 in the opposite direction of arrow (o), thus descending the occupant's haunches 12a from the divesting position to an original horizontal position as shown in FIG. 4. With the descending movement of the occupant 12, the underpiece 40 engages with the lower limit switch 41, while the upperpiece 38 moves away from the upper limit switch 39 to deenergize the motor 29 so as to cease the downward movement of the rack 28. Numeral 42 designates a stopper having one end mounted on the pivot shaft 27b of the rise-up mechanism 27, and having the other end connected to a roller 43. The stopper 42 pushes the roller 43 against a slope surface of a bias piece 44 which is provided at the rack 28 in a position between the stopper 42 and the underpiece 40 when the rack 28 moves upward to disengage the hook portion 30 from the pin 37. With the engagement of the roller 43 against the slope of the bias piece 44, the rise-up mechanism 27 rocks around the pivot shaft 27b in the direction of arrow (p) against the urging force of the coil spring 27a, thereby making it possible to readily disengage the hook portion 30 from the pin 37. This also maintains an appropriate distance between the hook portion 30 and the pin 37 so as to avoid an inadvertent interference of the hook portion 30 with the pin FIG. 6 shows a slippage preventing mechanism 45 which has a slide frame 46 slidably disposed in the lengthwise direction of the occupant 12 within the upper open end 1a (refer to FIG. 2). In the slippage preventing mechanism 45, a pair of rings 47 is rotatably secured to the rotational shaft 13. The ring 47 has a link 48 which is connected to an upper portion exterior of the bathtub 1 by way of links 49, 50. To a portion of the ring 47 remote from the link 48, a stud 51 is fixedly secured, to which a curved end of a lever 52 is pivotably connected by way of a pin 53. The other end of the lever 52 is pivotably connected to an underside of the slide frame 46 at its right end portion by means of a pin 54.

Figure 7:
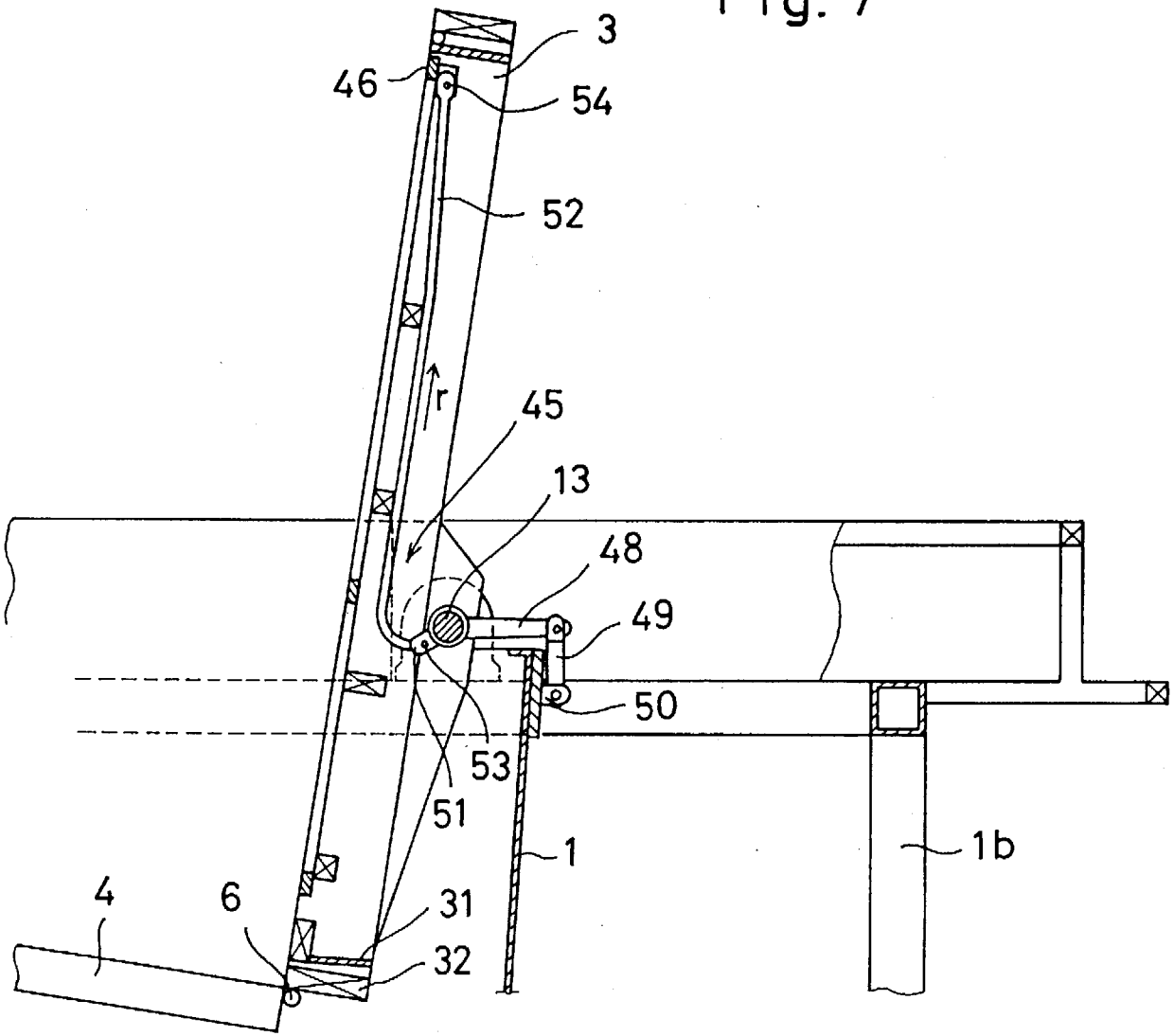
FIG. 7 is a partial cross sectional view of a slip cancelling mechanism showing how it works.

Upon pivoting the first bed plate 3 around the rotational shaft 13 in the direction of arrow (q) to change the bed section 2 from the rest position to the operative position, the slide frame 46 is constrained to pivot about the pin 53 under the restraint of the lever 52 so as to slightly move in the direction of arrow (r) within the inner frame 11 as shown in FIG. 7. This is caused by a dimensional arrangement of distances (t) and (s). The distance (t) between the pins 53, 54 is somewhat greater than the distance (s) between the pin 54 and the shaft 13. The slidable displacement of the slide frame 46 is predetermined as desired by a dimensional difference between the distances (t) and (s).

With the movement of the slide frame 46 in the direction of arrow (r), the back of the occupant 12 is slightly slidden toward its head portion in association with changing the bed section 2 from the rest position to the operative position, and thereby preventing the upward slippage of the back when changing the bed section 2 to the operative position.

Figure 8:
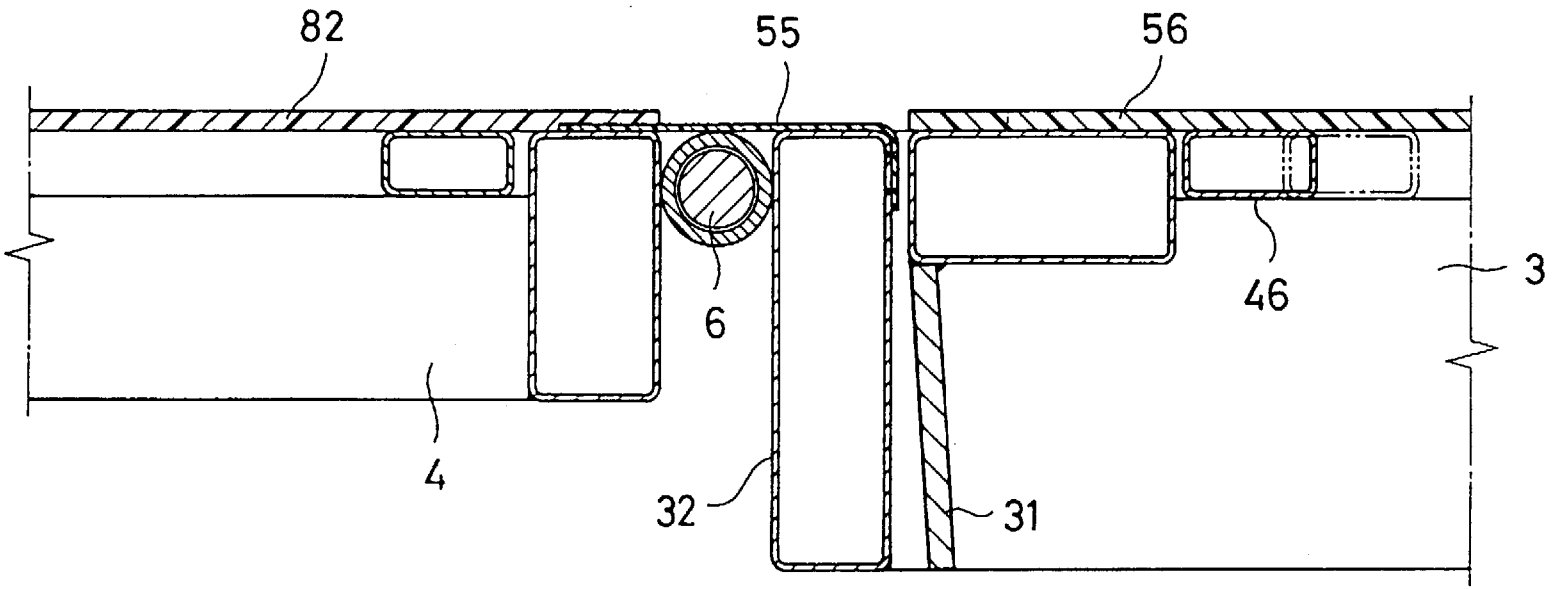
FIG. 8 is an enlarged cross sectional view of an elastic strip sheet showing how it works at the rest position.
Figure 9:
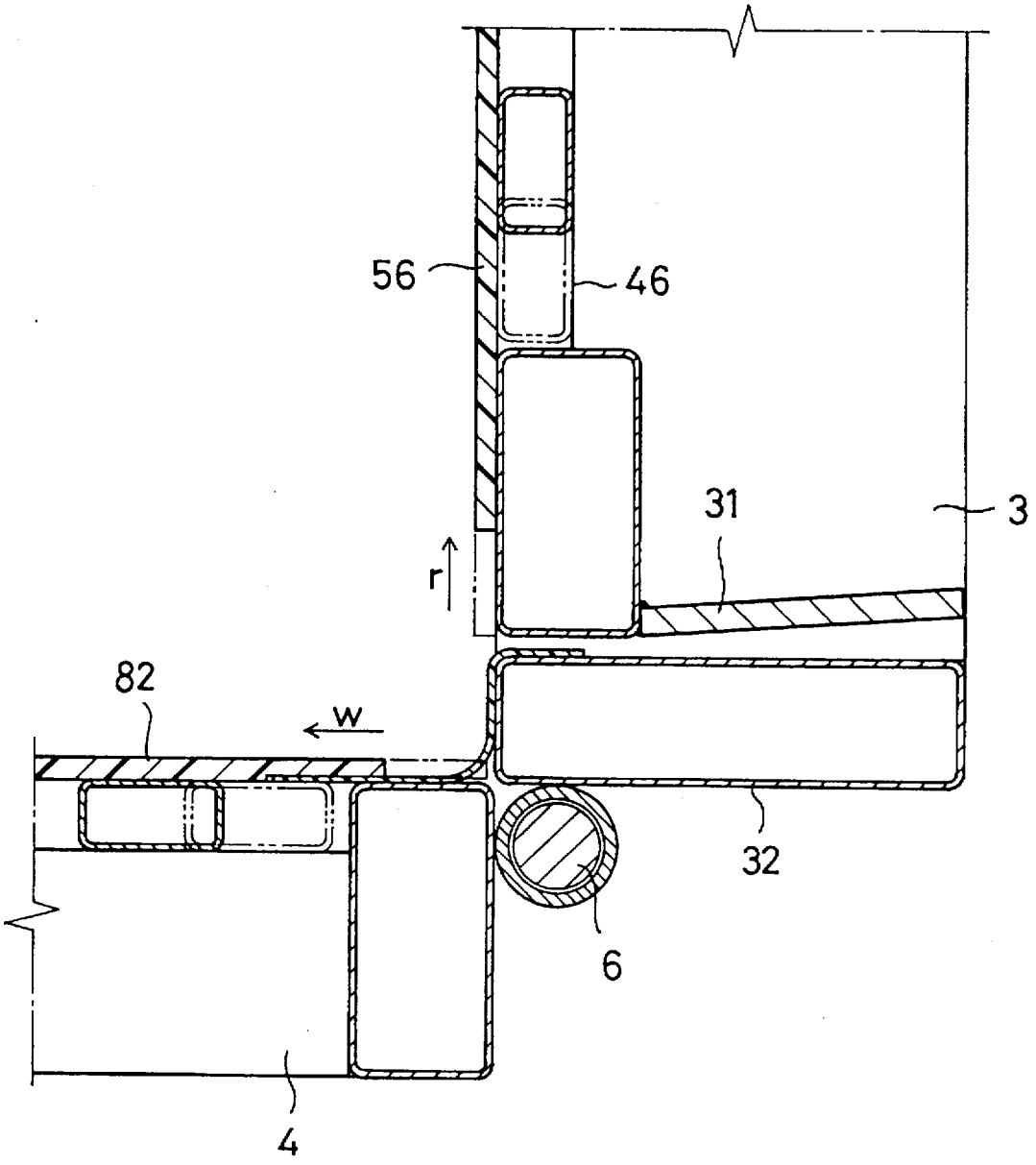
FIG. 9 is an enlarged cross sectional view of an elastic strip sheet showing how it works at the operative position.

FIGS. 8 and 9 show an enlarged cross section of a boundary of the hinge 6 between the first bed plate 3 and the second bed plate 4 of the bed section 2. In a manner to straddle the first and second bed plates 3, 4, a thin elastic strip sheet 55 is provided on the boundary by means of, for example, an adhesive agent. The elastic strip sheet 55 is made of rubber, flexible metal, synthetic resin or the like. The sheet 55 prevents the mattress 11 from being caught up between the first and second bed plates 3, 4 when each of the bed plates pivot around the hinge 6 as shown in FIG. 9. Numeral 56 designates a plate sheet provided on the slide frame 46 to overlap the inner frame 31 so as to slide in combination with the movement of the slide frame 46.

Figure 10:
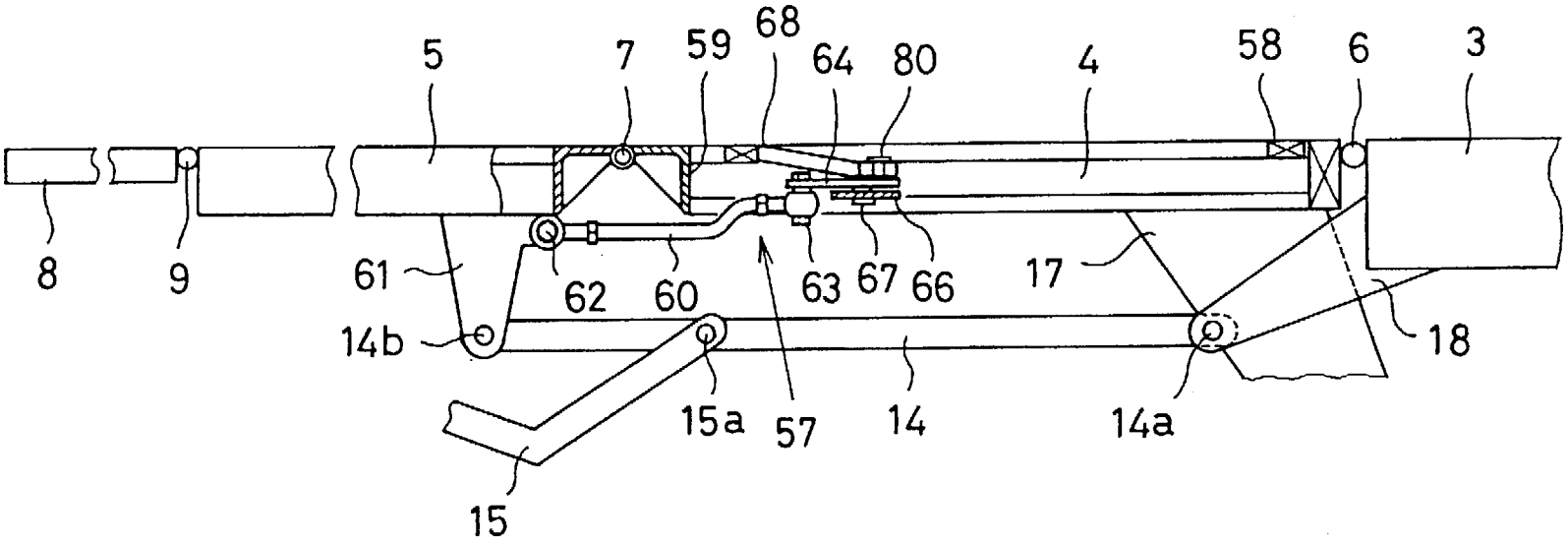
FIG. 10 is a partial cross sectional view of a slip cancelling mechanism mounted on a second bed plate of the bed section.
Figure 11:
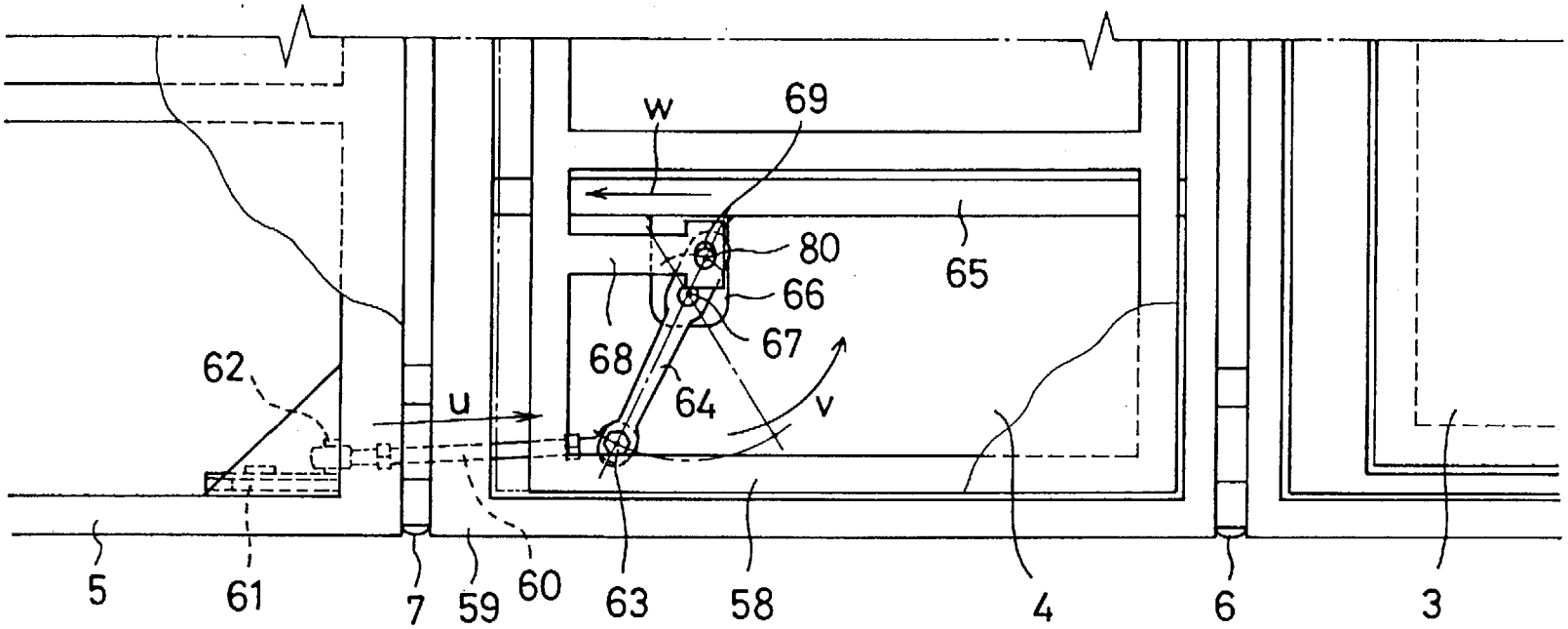
FIG. 11 is a partial plan view of a slip cancelling mechanism mounted on the second bed plate of the bed section.
Figure 12:
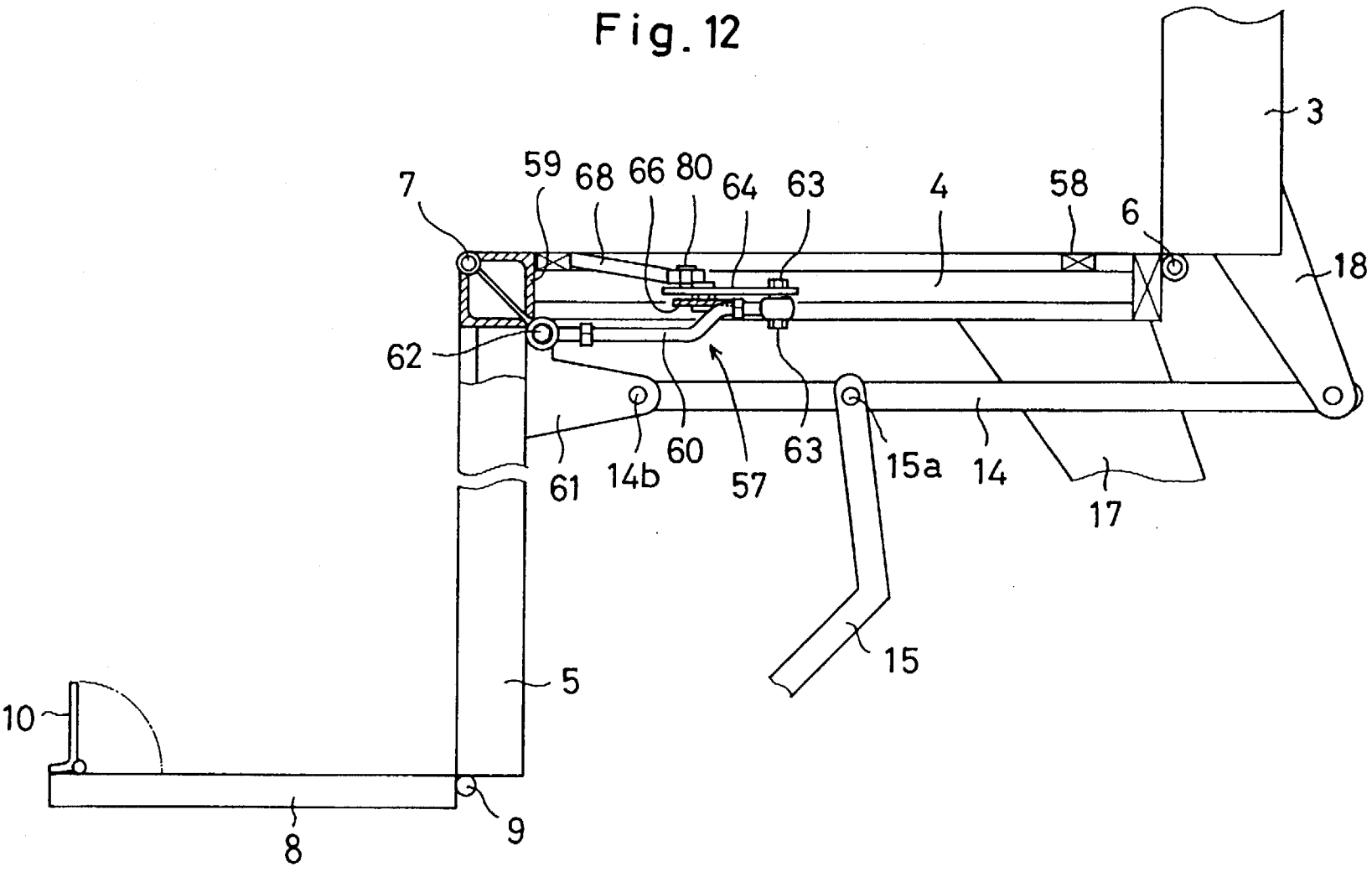
FIG. 12 is a longitudinal cross sectional view of a slip cancelling mechanism mounted on the second bed plate of the bed section.

FIGS. 10 through 12 show a pair of slippage preventing mechanism 57 each provided on the front and rear of the second bed plate 4. The slippage preventing mechanism 57 has a slide frame 58 slidably disposed within an upper open end of an outer frame 59 so as to slightly move within the outer frame 59 along the lengthwise direction of the occupant 12. A lever rod 60 has one end pivotably connected to a bracket arm 61 by way of a bolt 62. The bracket arm 61 is provided on an underside of the third bed plate 5 and pivotably connected to the link 14 by way of a pin 14b. The other end of the lever rod 60 is pivotably connected to one end of a link 64 by way of a pin 63. A middle portion of the link 64 is pivoted by a pin 67 on a support branch 66 laterally extended from a beam 65 laid across the outer frame 59. From the slide frame 58, a connection arm 68 is integrally extended in a manner to cross the support branch 66. On the extended end portion of the connection arm 68, an elongated hole 69 is provided in the latitudinal direction of the occupant 12. The other end of the link 64 has a vertical pin 80 pivotably admitted by the elongated hole 69.

With the changing movement of the bed section 2 from the rest position (FIG. 10) to the operative position (FIG. 11), the third bed plate 5 pivots downward about the hinge 7 to move the lever rod 60 in the direction of arrow (u) so as to pivot the link 64 about the pin 67 in the direction of arrow (v) as shown in FIG. 11. With the pivotal movement of the link 64, the connection arm 68 is pushed in the opposite direction of arrow (u) by way of the vertical pin 80 and elongated hole 69 so as to slightly move the slide frame 58 in the direction of arrow (w) as shown in FIG. 12. This moves the occupant's haunches 12*a* on the second bed plate 4 in the direction of arrow (w), and thereby preventing the forcible slippage against the second bed plate 4 so that the occupant can smoothly change to the operative position with ease.

Figure 13:
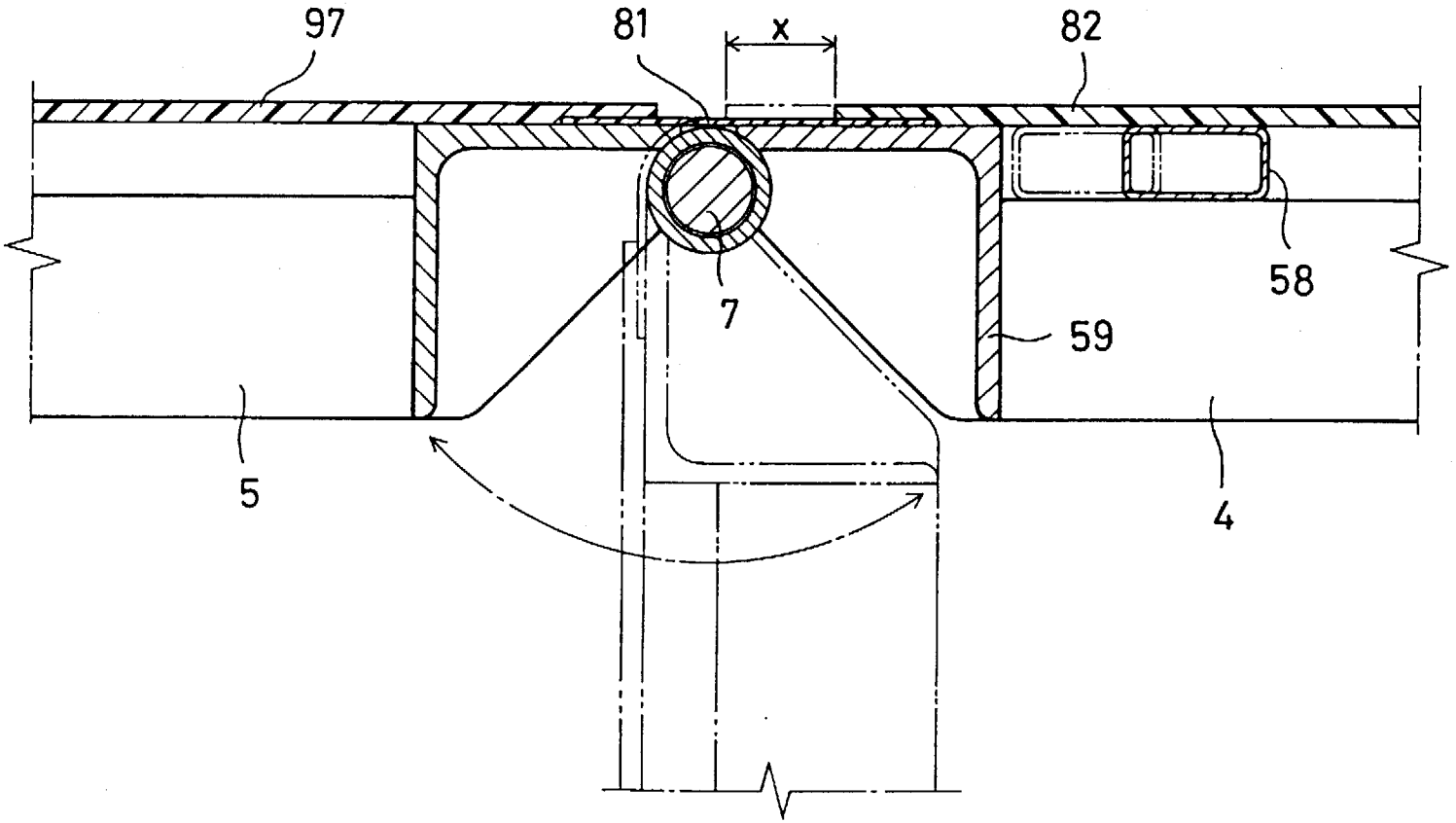
FIG. 13 is an enlarged cross sectional view of an elastic strip sheet showing how it works at the rest position.

FIG. 13 shows an enlarged cross section of a boundary of the hinge 7 between the second bed plate 4 and the third bed plate 5 of the bed section 2. In a manner to straddle the second and third bed plates 4, 5, a thin elastic strip sheet 81 is provided on the boundary by means of, for example, an adhesive agent. In the same manner as the sheet 55 between the first and second bed plates 3, 4, the elastic strip sheet 81 is made of rubber, flexible metal, synthetic resin or the like. The sheet 81 prevents the mattress 11 from being caught up between the second and third bed plates 4, 5 when each of the bed plates pivot around the hinge 7 to return back from the phantom-lined position to the solid-lined position as shown in FIG. 13. Numeral 82 designates a plate sheet provided on the slide frame 58 to overlap the outer frame 59 so as to slide in combination with the movement of the slide frame 58.

In this instance, it is to be observed that a reciprocal displacement (x) which the plate sheet 82 moves with the slide frame 58 is shown by a double-headed arrow in FIG. 13.

Figure 14:
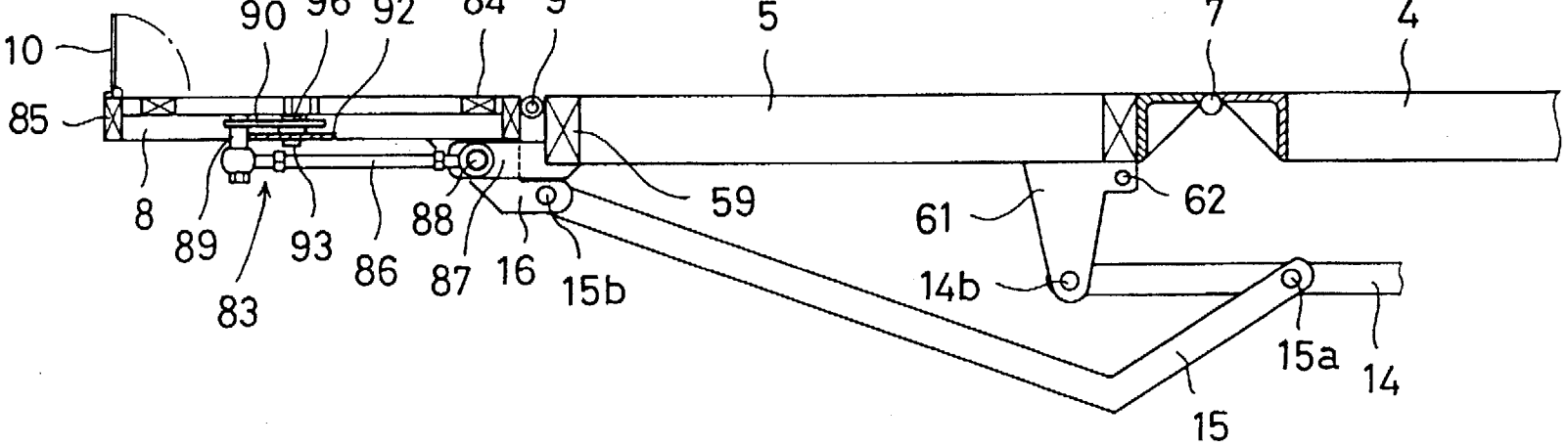
FIG. 14 is a partial cross sectional view of a foot position adjusting mechanism showing how it works.
Figure 15:
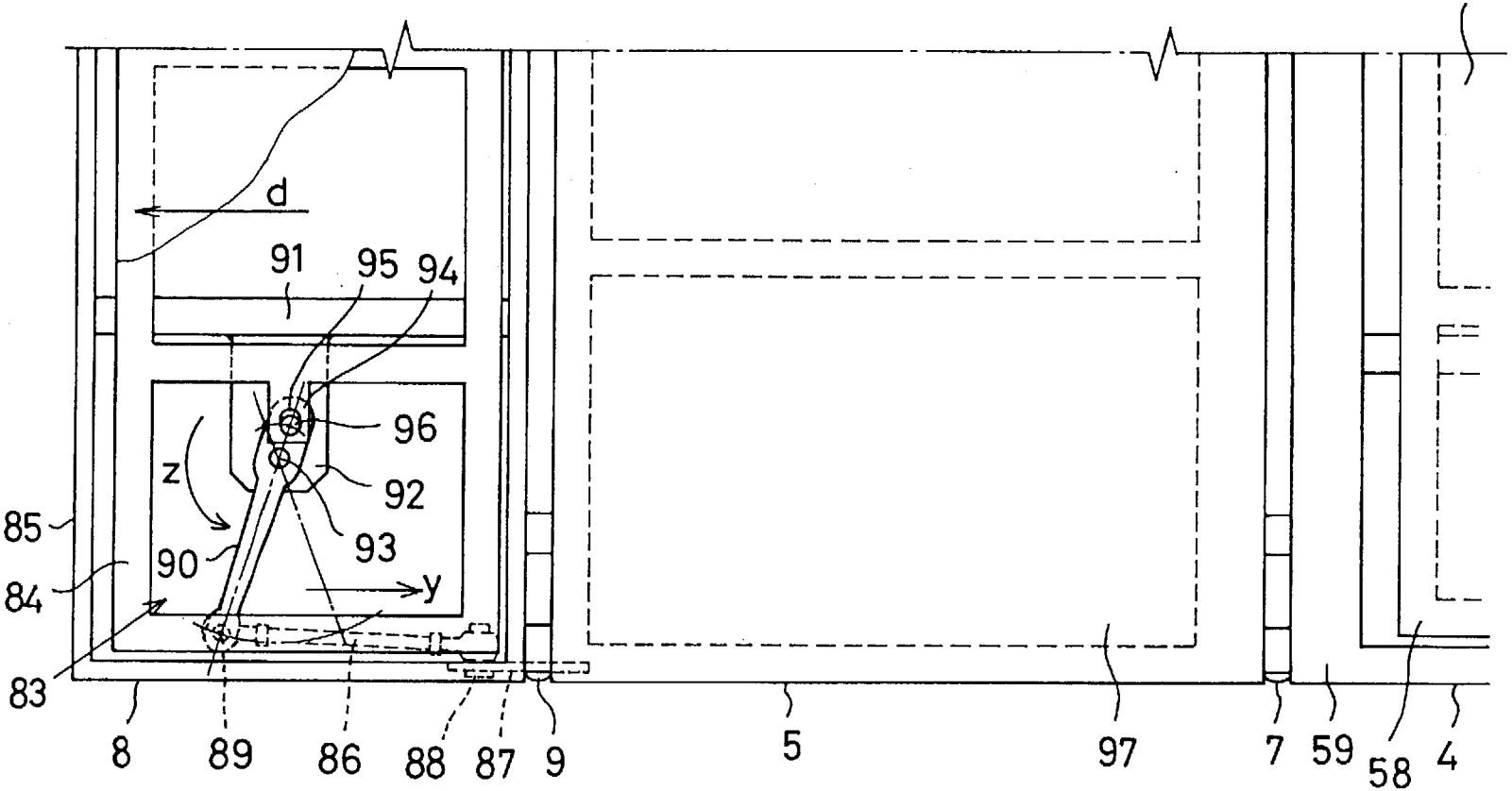
FIG. 15 is a partial plan view of a foot position adjusting mechanism showing how it works.
Figure 16:
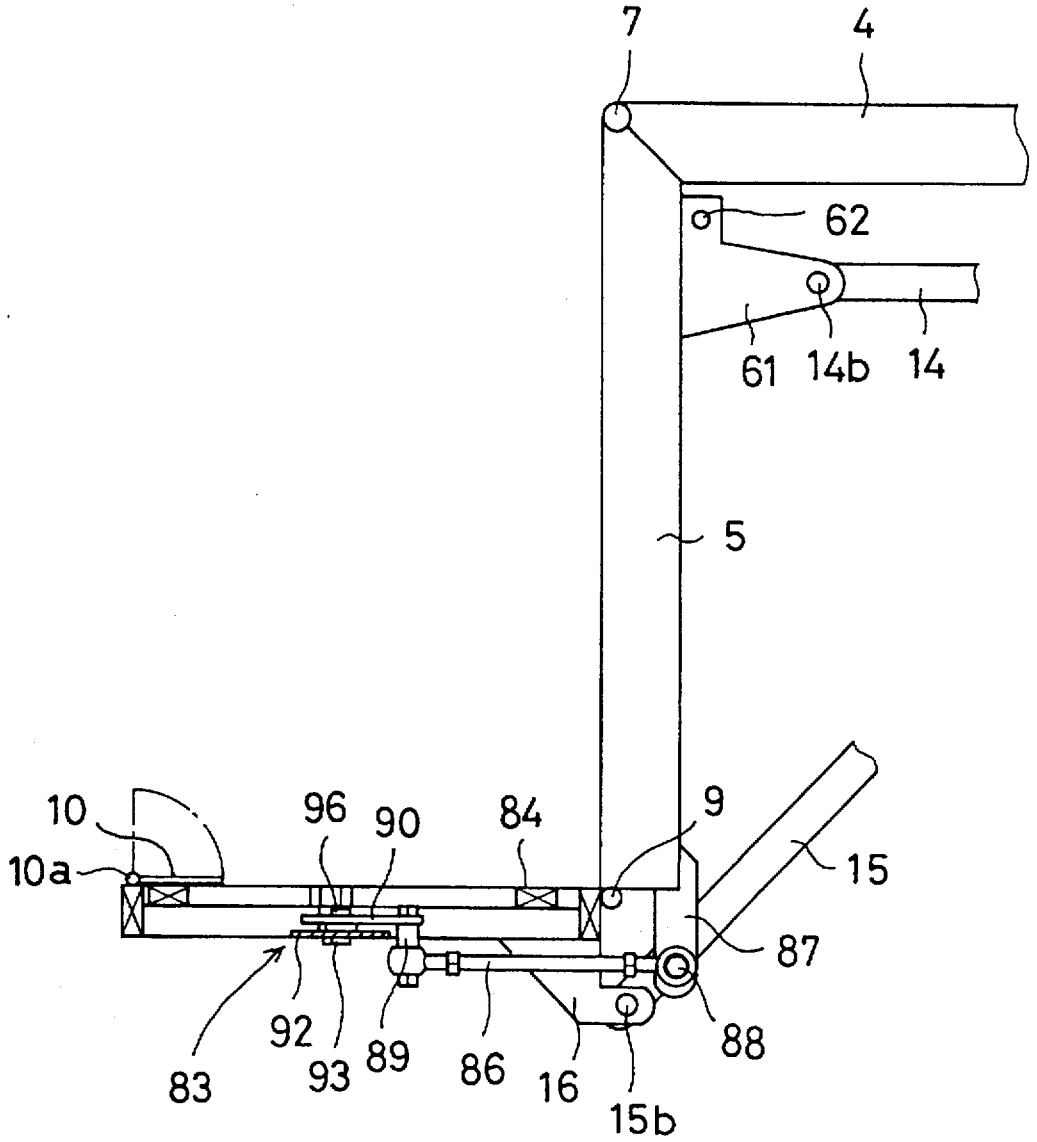
FIG. 16 is a partial cross sectional view of a foot position adjusting mechanism showing how it works at the operative position.

FIGS. 14 through 16 show a pair of foot position adjusting mechanisms each designated by numeral 83. The foot position adjusting mechanism 83 is provided on the front and behind of the foot rest plate 8 of FIG. 2. Numeral 84 designates a slide frame provided within an upper open end of an outer frame 85 of the rest plate 8. The slide frame 84 is adapted to slightly move within the outer frame 85 in the lengthwise direction of the bed section 2. A lever 86 has one end pivotably connected by means of a bolt 88 to a lateral arm 87 provided on an underside of the third bed plate 5. The other end of the lever 86 is connected through a pin 89 to a link 90 which is pivoted by a pin 93 to a lateral support arm 92 extended from a beam 91 laid across the outer frame 85. From the slide frame 84, a connection arm 94 is integrally extended in a manner to cross the lateral support arm 92. On the extended end portion of the connection arm 94, an elongated hole 95 is defined in the latitudinal direction of the occupant 12. The other end of the link 90 has a vertical pin 96 pivotably admitted by the elongated hole 95.

Figure 5:
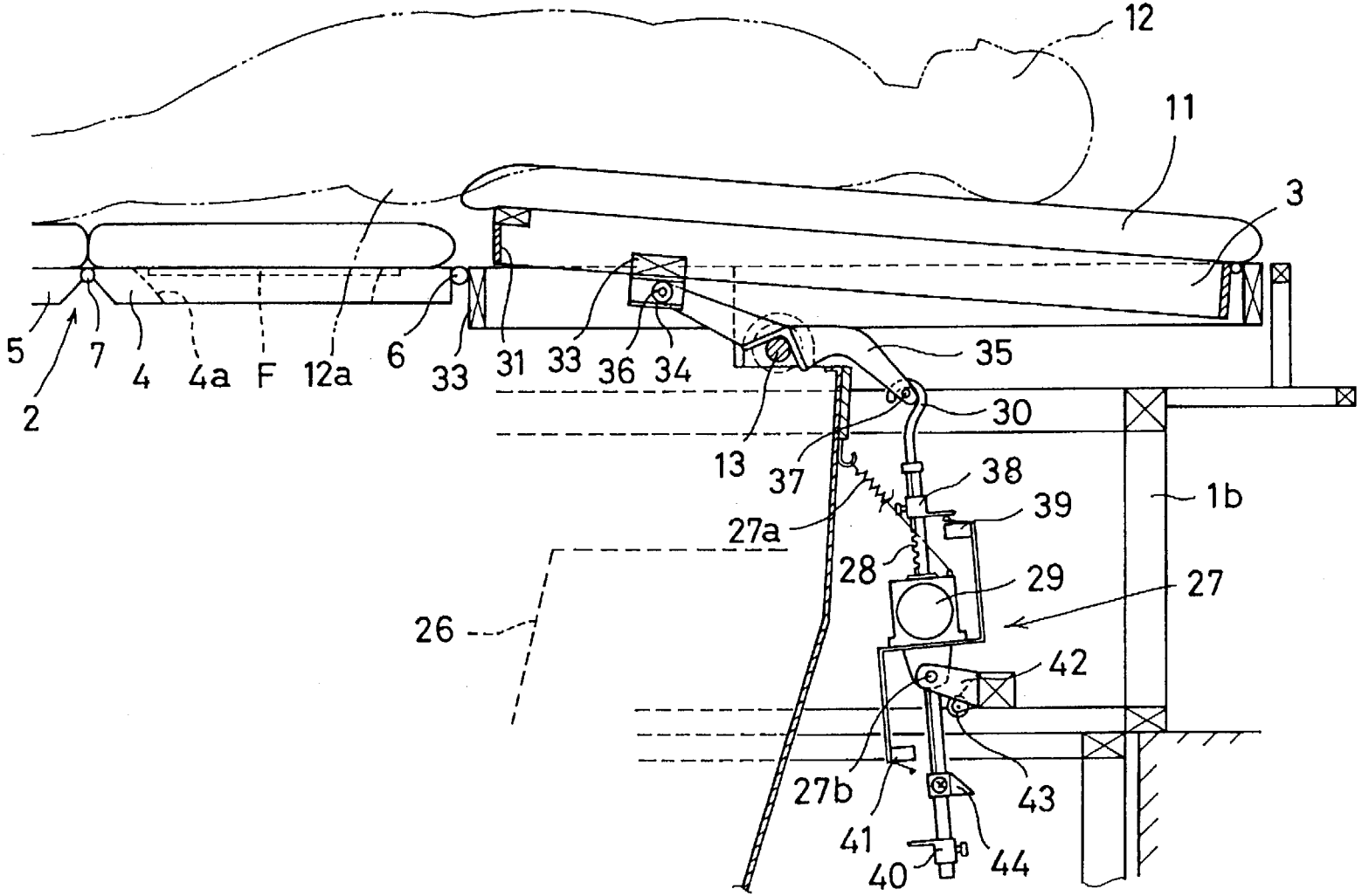
FIG. 5 is a partial cross sectional view mainly showing a pedestal plate after being pushed upward to raise the occupant's haunches.

With the change of the bed section 2 from the rest position (FIG. 14) to the operative position (FIG. 16), the foot rest plate 8 pivots downward about the hinge 8 to move the lever 86 in the direction of arrow (y) of FIG. 5 so as to pivot the link 90 about the pin 93 in the direction of arrow (z). With the pivotal movement of the link 90, the connection arm 94 is pushed in the opposite direction of arrow (y) by way of the vertical pin 96 and elongated hole 95 so as to slightly move the slide frame 84 in the direction of arrow (d).

This moves the occupant's feet on the foot rest plate 8 outward in the direction of arrow (z) to occupay the operative position shown in FIG. 16, and thereby preventing the occupant from feeling his or her legs forcibly retracted inward so that the occupant can smoothly change to the operative position at ease.

In combination with the change toward the operative position, the stop bar 10 falls down around a pin 10*a* under the influence of its weight as shown at the left side in FIG. 16. In the same manner as the first and second bed plates 3, 4, a thin plate sheet 97 is provided on the third bed plate 5.

Figure 17:
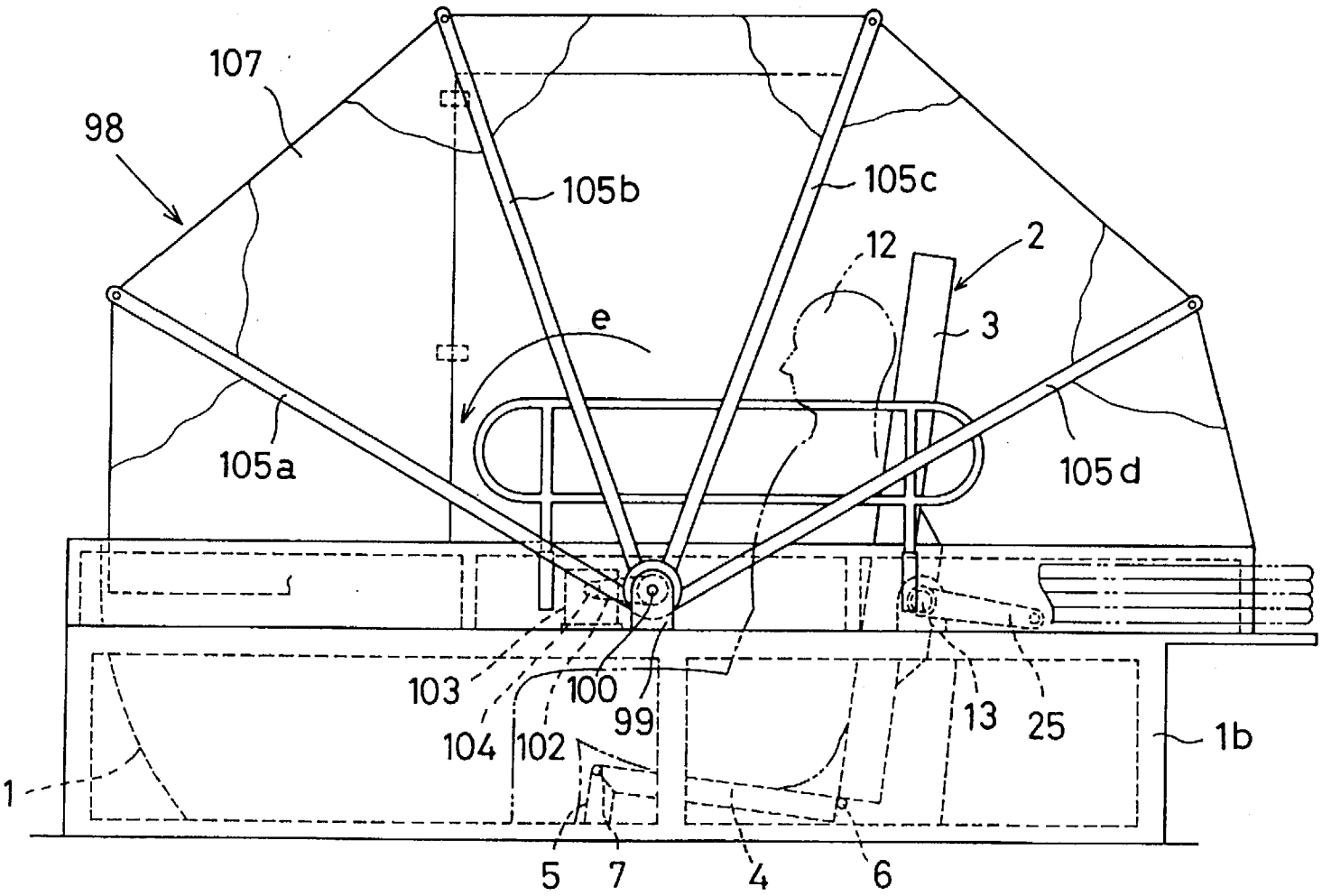
FIG. 17 is a plan view of a canopy.
Figure 18:
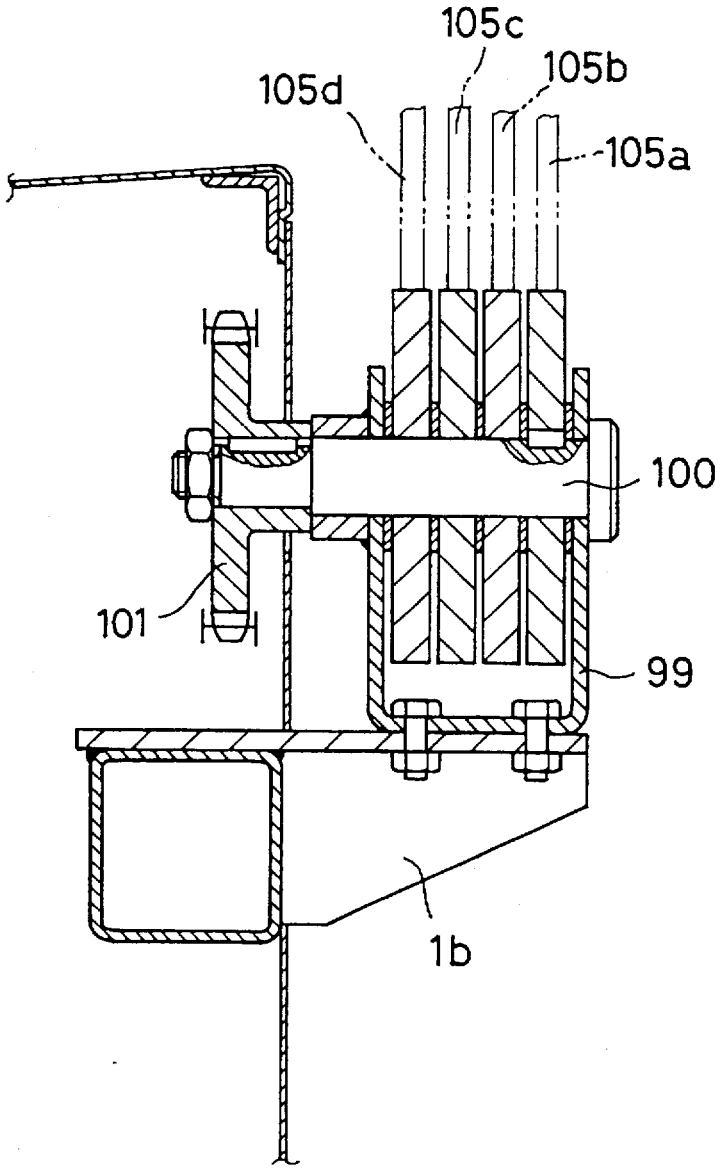
FIG. 18 is an enlarged cross sectional view of a support which supports ribs of the canopy.
Figure 19:
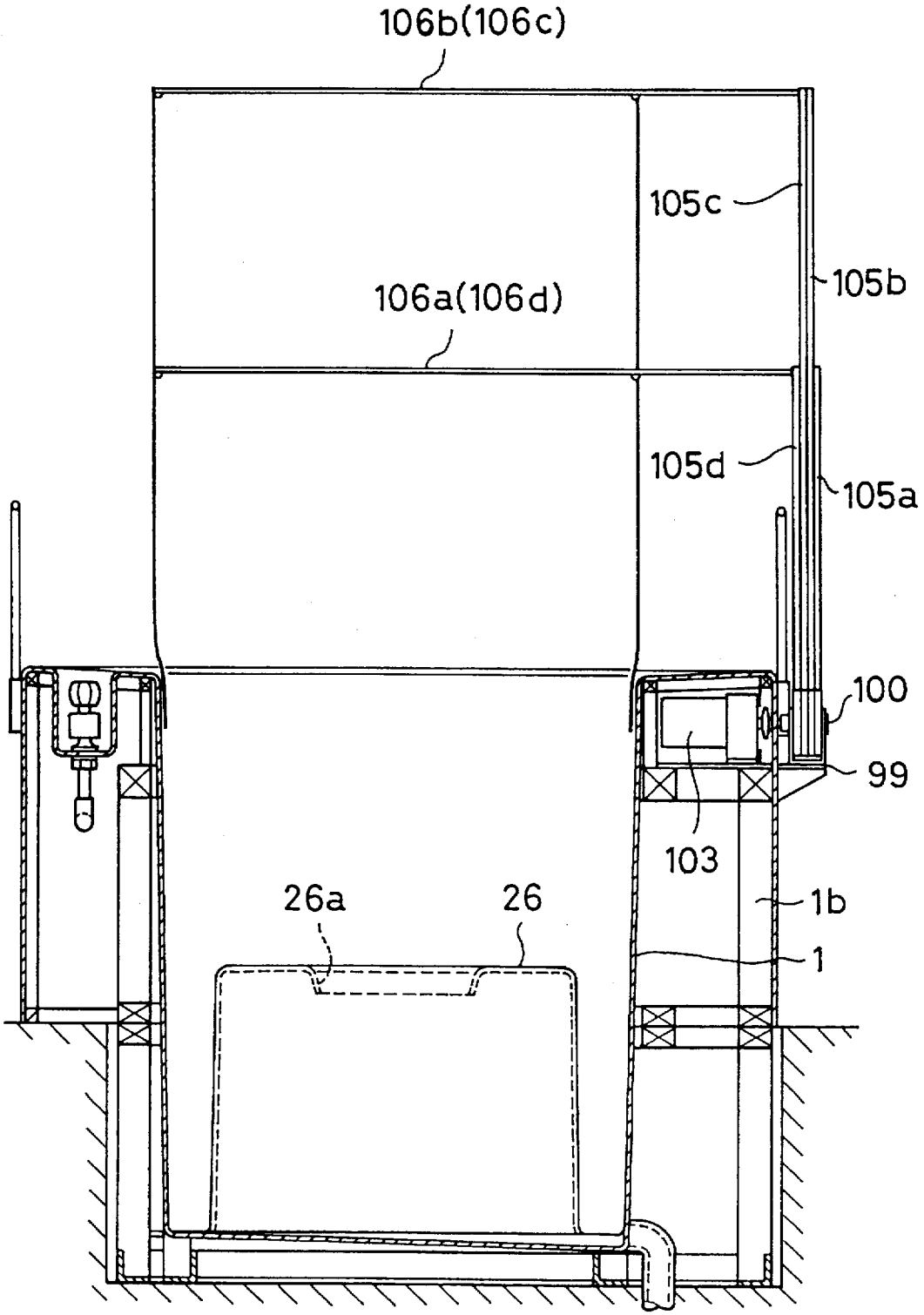
FIG. 19 is a longitudinal cross sectional view of the canopy when in use.
Figure 20:
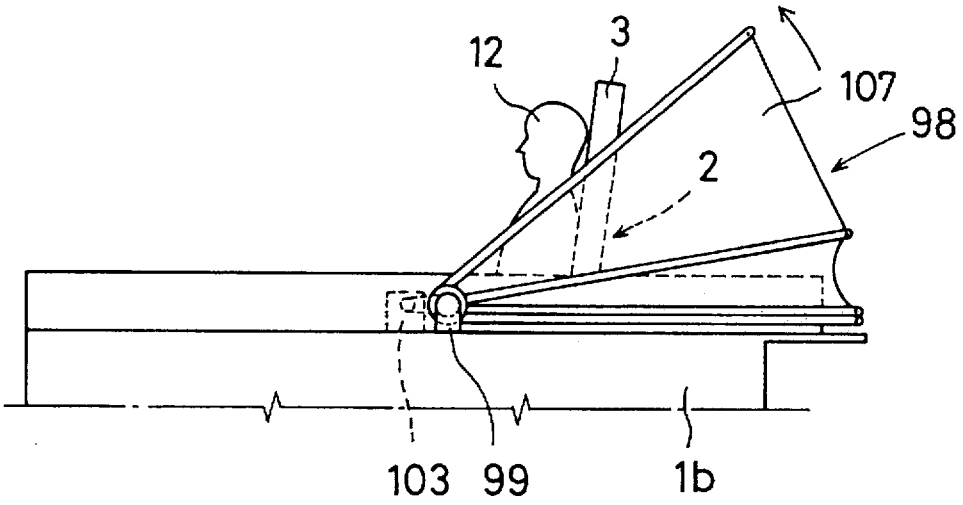
FIG. 20 is a partial plan view of the canopy when it begins to open.
Figure 21:
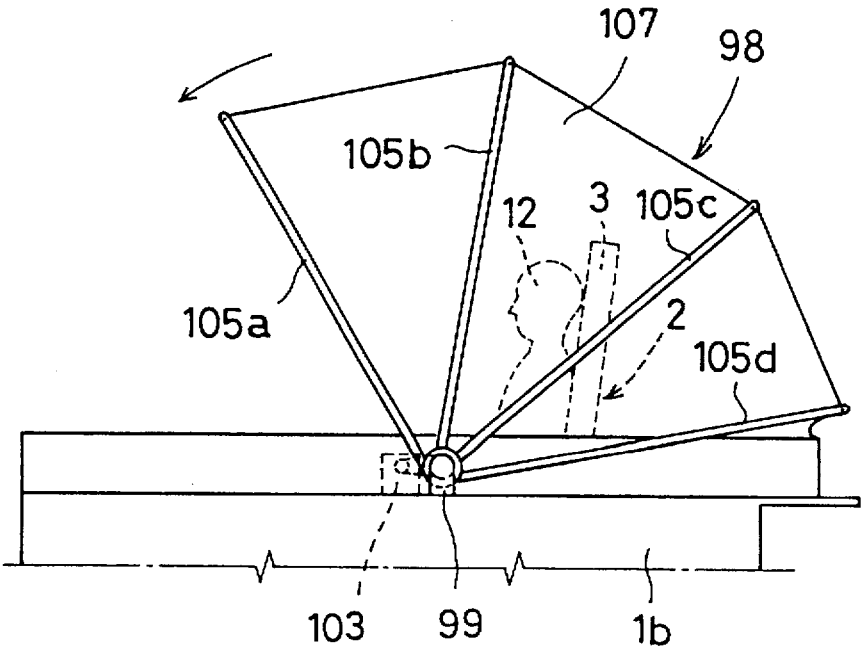
FIG. 21 is a partial plan view of the canopy when it is fully opened.

FIGS. 17 through 21 show a canopy 98 provided so that the occupant is not directly exposed to the outside particularly upon taking a bath or relieving themselves. The canopy 98 has a U-shaped anchor bracket 99 provided on a middle portion of a lengthwise beam of the frame structure 1*b* which is installed to surround the bathtub 1. Across the anchor bracket 99, an axle 100 is laid to have a sprocket 101 which is connected to a drive shaft 104 of a reduction motor 103 through a chain 102 as shown in FIG. 18. To a portion of the axle 100 within the anchor bracket 99, each lower end of e.g., four ribs 105*a*~105*d* is connected which are made of a reinforced plastic material, for example. The lower end of the first rib 105*a* is fixedly mounted on the axle 100, and the rest of the ribs 105*b*~105*d* are in a free-wheeling relationship with the axle 100. Each upper end of the ribs 105*a*~105*d* has a lateral extension having a length equivalent to a width of the bathtub 1 as designated by numerals 106*a*~106*d* in FIG. 19. These ribs 105*a*~105*d* and lateral extensions 106*a*~106*d* form an inverted L-shaped configuration as a whole, and are wrapped by a collapsible hood 107 which is made of e.g., a thin sheet of plastic material. The ribs 105*a*~105*d* and the extensions 106*a*~106*d* are usually rested on the frame structure 1*b* in a manner to surround the bathtub 1 in an overlapping relationship with each other as shown at phantom lines in FIG. 17.

When desired to use the canopy 98 upon relieving themselves or taking a bath, the reduction motor 103 is energized by the teleoperational panel to rotationally drive the sprocket 101 by way of the chain 102, thus pivoting the first rib 105*a* and the corresponding extension 106*a* about the axle 100 in the direction of arrow (e) in FIG. 17. With the movement of the rib 105*a* and the extension 106*a*, it becomes possible to begin unfolding the hood sheet 107 folded on the frame structure 1*b* like an accordion middle. Then the second, third and last ribs 105*b*~105*d* together with the extensions 106*b*~106*d* are successively pulled to each pivot around the axle 100 by a traction of the unfolded portion of the hood sheet 107 as shown at intermediate stages in FIGS. 20, 21. In cooperation with the ribs 105*a*~105*d* and the extensions 106*a*~106*d*, the hood sheet 107 is finally opened fully fanwise to conceal the occupant 12 in the bathtub 1 as shown in FIG. 17.

Upon relieving themselves or taking a bath, the canopy 98 thus conceals the occupant 12 in the bathtub 1 so as to render him or her obscure from outside, and whereby the occupant can meets his or her daily needs without being disturbed by the outside. This is particularly convenient when a nervous occupant has been long suffering from sickness.

As understood from the foregoing description, the rise-up mechanism 27 effectively raises the occupant's haunches 12*a* and waist from the bed plate 2, thus helping significantly lessen the burden the attendant usually bears. This is particularly helpful when the occupant is heavy in weight.

The slippage preventing mechanism 45, 57 enables the occupant to cancel the forcible slip against the bed plates 3, 4, 5 so as to comfortably change the bed section 2 from the rest position to the operative position.

With the thin elastic strip sheets 55, 81 provided on the boundary between the bed plates 3, 4 and between the bed plates 4, 5, it is conveniently possible to prevent the mattress 11 from being inadvertently caught up between the bed plates.

With the installation of the foot position adjusting mechanism 83, it is possible to move the occupant's legs outward in combination with the slide frame 84. This is favorably particularly for the occupant afflicting with a rickety knee.

Upon taking a bath, the canopy 98 favorably prevents the aqua vapor from leaking out of the hood sheet 107. Upon relieving themselves or taking a bath, the canopy 98 conceals the occupant 12 in the bathtub 1 so as to render him or her obscure from the outside, and whereby the occupant can meets his or her daily needs without being disturbed by the outside. This is particularly convenient when a nervous occupant has been long suffering from sickness, thus apparently enabling the attendant to nurse the occupant with great care.

It is noted that the number of the ribs 105*a*~105*d* is not confined to four, it is possible to further add or reduce the number. The 105*a*~105*d* may be disposed at regular or irregular intervals.

It is appreciated that the hood 107 of the canopy 98 may be preferably made of a thin sheet collapsible material like the accordion middle. By way of illustration, the hood 107 may be made from a synthetic fiber such as nylon, polyethylene or polyester. Otherwise, an oil-treated water repellent paper may be used as the hood sheet 107. Upon using the canopy 98, the canopy 98 may be selectively operated irrespective of the positional change of the bed section 2.

It is observed that the presently invented invalid bed is not merely installed in home, hospital or medical clinic facilities but other places as well. The canopy 98 may be installed on both beams of the frame structure 1*b*, or otherwise the canopy 98 may be removably or selectively installed.

While the invention has been described with reference to the specific embodiments, it is understood that this description is not to be construed in a limiting sense in as much as various modifications and additions to the specific embodiments may be made by skilled artisans without departing from the scope of the invention.

What is claimed is:

1. A collapsible bed structure for bed-ridden invalids, comprising:

a bed section horizontally supported by a rotational shaft, for being provided on an upper open end of a bathtub, the bed section having at least first, second and third bed plates each pivotably connected at their neighboring side;

means for moving the bed section between a rest position in which the first, second and third bed plates are horizontally supported and an operative position in which the first, second and third bed plates are supported in a chair-shaped configuration within the bathtub, said moving means comprising:

a pedestal plate pivotably placed at one end by a hinge to the first plate of the bed section;

a rocker arm, rotatably mounted on the rotational shaft;

a rack provided to engage the rocker arm, the rack being moved in an axial direction by an electric motor;

wherein when the rack is moved in an axial direction downward, the rocker arm pivots around the rotational shaft to cause the pedestal plate to move upward around the hinge so as to raise haunches of an occupant lying on the bed section to expedite the occupant's divestiture; and a slide plate slidably mounted on each of the first and second bed plates of the bed section to slightly slide along a lengthwise direction of the occupant by an action of a lever so as to prevent a slippage between the occupant lying on the bed section and the first and second bed plates when changing the bed section from the rest position to the operative position.

2. A collapsible bed structure for bed-ridden invalids as recited in claim 1, wherein a foot plate is pivotably connected to have a slide plate slidably mounted on the foot plate so as to slightly slide the foot plate outwardly when changing the bed section from the rest position to the operative position.

3. A collapsible bed structure for bed-ridden invalids as recited in claim 1, wherein a canopy is provided which has a plurality of inverted L-shaped ribs and a hood provided to wrap the ribs, each lower end of the ribs being collected to be pivotably supported by the upper open end of the bathtub so as to change the canopy between a first position in which the ribs are rested on the upper open end of the bathtub and a second position in which the ribs are open fanwise so as to conceal the occupant lying on the bed section.

4. A collapsible bed structure for bed-ridden invalids as recited in claim 3, wherein the canopy further comprises:

a frame structure having a lengthwise beam;

a U-shaped anchor bracket provided on a middle portion of said lengthwise beam of said frame structure;

an axle laid across said anchor bracket to which the lower end of each of the ribs is connected; and a lateral extension for each upper end of the ribs such that the ribs form an inverted L-shape and rest on said frame structure such that the bathtub is surrounded in an overlapping relationship with the ribs.

5. A collapsible bed structure for bed-ridden invalids as recited in claim 1, wherein an elastic strip sheet is provided at a boundary straddling at least the first and second bed plates so as to prevent a mattress on a bed section from being caught up therebetween.

6. A collapsible bed structure for bed-ridden invalids as recited in claim 1, wherein an opening is provided on the second bed plate in correspondence to a toilet placed on a bottom of the bathtub, so that the opening meets an upper portion of the toilet with no warm water supplied to the bathtub when changing the bed section from the rest position to the operative position.

7. A collapsible bed structure for bed-ridden invalids as recited in claim 1, wherein said moving means further comprises a linkage structure of pins and links connected to the first, second and third bed plates to support and move the first, second, and third bed plates.

8. A collapsible bed structure for bed-ridden invalids as recited in claim 1, wherein said moving means further comprises:

a roller movably mounted on a rail, and a hook portion, wherein the rocker arm has one end pivotably connected to the roller, and another end detachably connected to the hook portion by way of a pin, such that when the rack is moved in the axial direction, the rack engages the hook portion with the pin, thus pivoting the rocker arm around the rotational shaft, and with the pivotal movement of the rocker arm, the roller moves along the rail to pivot the pedestal plate upward about the rotational shaft and raise haunches of the occupant lying on the bed section.

* * * * *